US008332147B2

(12) United States Patent
Robinson

(10) Patent No.: US 8,332,147 B2
(45) Date of Patent: Dec. 11, 2012

(54) METHOD OF SURVEYING A RAILROAD TRACK UNDER LOAD

(76) Inventor: Tim Robinson, Fremont, NE (US)

( * ) Notice: Subject to any disclaimer, the term of this patent is extended or adjusted under 35 U.S.C. 154(b) by 637 days.

(21) Appl. No.: 12/589,350

(22) Filed: Oct. 22, 2009

(65) Prior Publication Data

US 2011/0098925 A1 Apr. 28, 2011

(51) Int. Cl.
*G01C 21/00* (2006.01)

(52) U.S. Cl. ..... 701/470

(58) Field of Classification Search ..... 701/19–20, 701/400, 468, 470; 246/1 R, 2 R; 105/1.4, 105/26.05

See application file for complete search history.

(56) References Cited

U.S. PATENT DOCUMENTS

| | | | | |
|---|---|---|---|---|
| 3,939,331 | A | 2/1976 | Theurer et al. | |
| 4,691,565 | A * | 9/1987 | Theurer | 73/146 |
| 6,014,815 | A | 1/2000 | Jager | |
| 6,220,170 | B1 | 4/2001 | Theurer et al. | |
| 6,856,865 | B2 | 2/2005 | Hawthorne | |
| 7,050,926 | B2 | 5/2006 | Theurer et al. | |
| 7,734,383 | B2 * | 6/2010 | Philp et al. | 701/19 |
| 2005/0107954 | A1 * | 5/2005 | Nahla | 701/301 |

* cited by examiner

*Primary Examiner* — Yonel Beaulieu
(74) *Attorney, Agent, or Firm* — Dennis L. Thomte; Thomte Patent Law Office LLC

(57) ABSTRACT

A method of inspecting or surveying a railroad track under load is described wherein a GPS receiver is mounted on top of the track vehicle such as a locomotive, high-rail vehicle or cargo car with data being collected at predetermined intervals to provide horizontal and vertical data for each location.

9 Claims, 3 Drawing Sheets

METHOD OF SURVEYING A RAILROAD TRACK UNDER LOAD

BACKGROUND OF THE INVENTION

1. Field of the Invention

This invention relates to a process or method of using survey-grade Global Positioning System (GPS) equipment mounted on a railroad track vehicle which will take close interval measurements of the railroad track position while being under load from the weight of the railroad track vehicle. The measurements will have horizontal and vertical positioning for each location.

2. Description of the Related Art

Using conventional methods, railroad tracks are inspected and/or surveyed by means of a survey technician utilizing a GPS receiver to locate survey features on site. In the conventional survey method, the features are located by placing the GPS receiver on the feature and taking a GPS observation for five seconds. Normally, if a railroad track is to be surveyed, the track must be shut down to traffic which creates a substantial logistical problem. Further, when several tracks are positioned adjacent to one another in close proximity, such as in a hump yard or the like, the survey technicians are exposed to dangerous conditions due to traffic on adjacent tracks. Because of these safety factors, adjacent tracks must be shut down while surveys are being conducted. Further, the conventional survey methods using GPS equipment consume extensive periods of time. Additionally, when a railroad track is surveyed using conventional GPS equipment, such a survey will not reveal or indicate deflection of the track under load as a locomotive or other track vehicles pass over the site.

SUMMARY OF THE INVENTION

This Summary is provided to introduce a selection of concepts in a simplified form that are further described below in the Detailed Description. This Summary is not intended to identify key aspects or essential aspects of the claimed subject matter. Moreover, this Summary is not intended for use as an aid in determining the scope of the claimed subject matter.

The method of surveying a railroad track under load is described which comprises the steps of: (1) providing a track vehicle which may be moved along the railroad track; (2) positioning a first GPS receiver on the track vehicle; (3) positioning a second stationary GPS receiver remotely from the first GPS receiver with the stationary GPS receiver being in radio communication with the first GPS receiver; (4) moving the track vehicle along the railroad track so that the first GPS receiver receives data from a plurality of satellites relating to the horizontal position and the vertical elevation of the first GPS receiver at predetermined intervals; and (5) collecting the data received by the first GPS receiver with the height of the first receiver above the railroad track being subtracted thereto to provide the actual vertical elevation of the track at each of the predetermined intervals or locations while the track is under load.

In the preferred embodiment, the first GPS receiver is positioned on the track vehicle so as to be centrally positioned between the rails of the railroad track. In the preferred embodiment, the first GPS receiver is positioned on top of the track vehicle so that the signals from the GPS satellite are not blocked by passing traffic or obstacles. In the preferred embodiment, a data collector which is preferably hand-held is positioned in the track vehicle to collect data from the first GPS receiver.

In a second embodiment of the method, a pair of spaced-apart GPS receivers are positioned on the track vehicle so that data relating to the vertical elevation of each of the rails of the railroad track may be collected and supplied to a pair of data collectors positioned within the track vehicle. In the preferred embodiment, the track vehicle is a locomotive but the vehicle could be a high-rail vehicle or a cargo car, as well.

It is therefore a principal object of the invention to provide an improved method for surveying a railroad track while the track is under load.

A further object of the invention is to provide a method of surveying a railroad track which reduces the risk of personal injury to the survey technicians.

A further object of the invention is to provide a method of surveying a railroad track wherein a GPS receiver is mounted on a track vehicle with the track vehicle being moved along the track while the survey is being conducted.

A further object of the invention is to provide a method of surveying a railroad track which greatly decreases the time needed to survey the track.

A further object of the invention is to provide a method of surveying a railroad track which eliminates the need of closing down adjacent tracks as a track is being surveyed.

A further object of the invention is to provide a method of surveying a railroad track which provides the vertical elevation of the track as the track is being subjected to the weight or load of a track vehicle passing thereover.

These and other objects will be apparent to those skilled in the art.

BRIEF DESCRIPTION OF THE DRAWINGS

Non-limiting and non-exhaustive embodiments of the present invention are described with reference to the following figures, wherein like reference numerals refer to like parts throughout the various views unless otherwise specified.

DESCRIPTION OF THE PREFERRED EMBODIMENT

Figure 1:
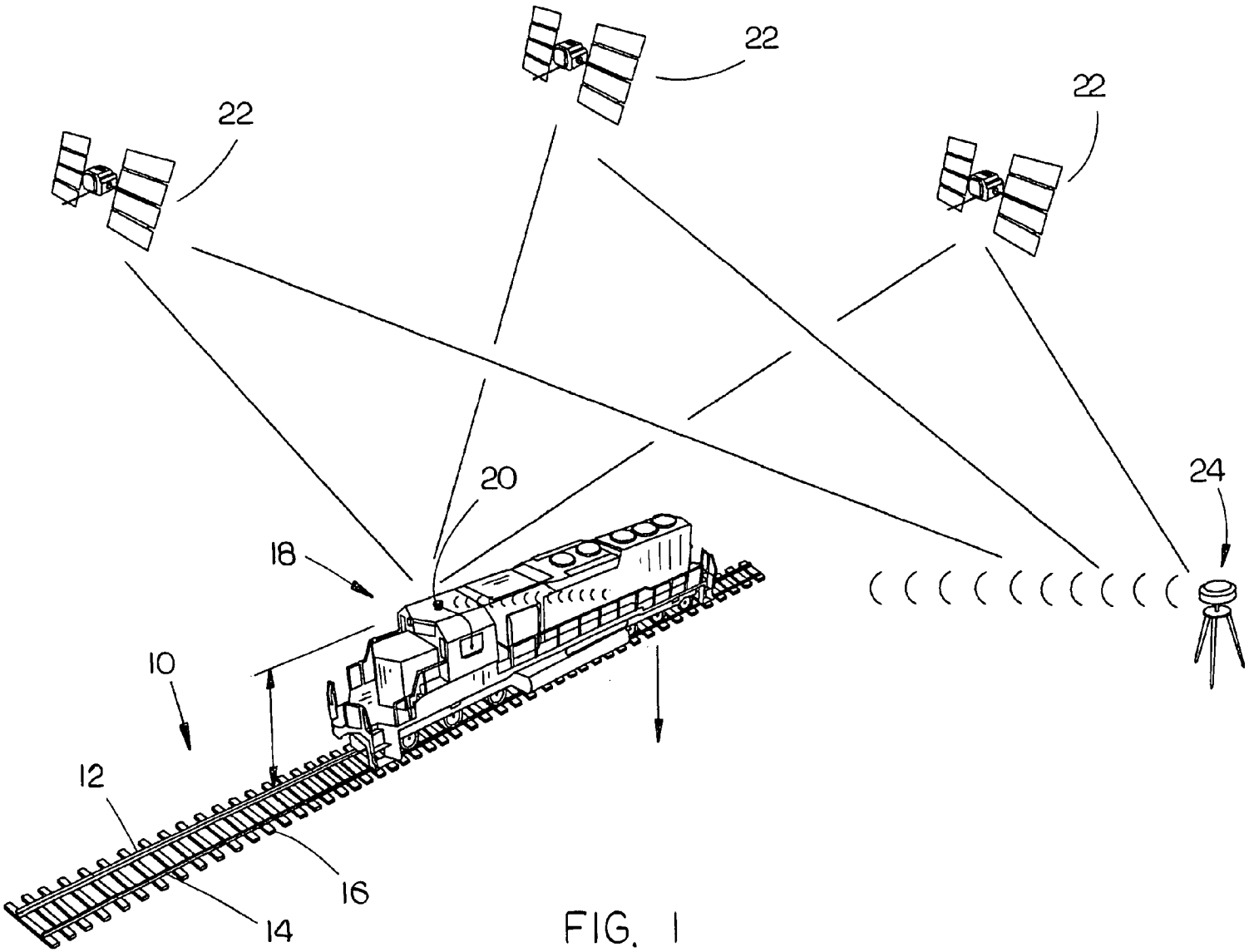
FIG. 1 is a perspective view of a locomotive moving along a railroad track having a GPS receiver mounted on the upper portion thereof which is in communication with a plurality of GPS satellites and a stationary GPS receiver located remotely of the locomotive.
Figure 2:
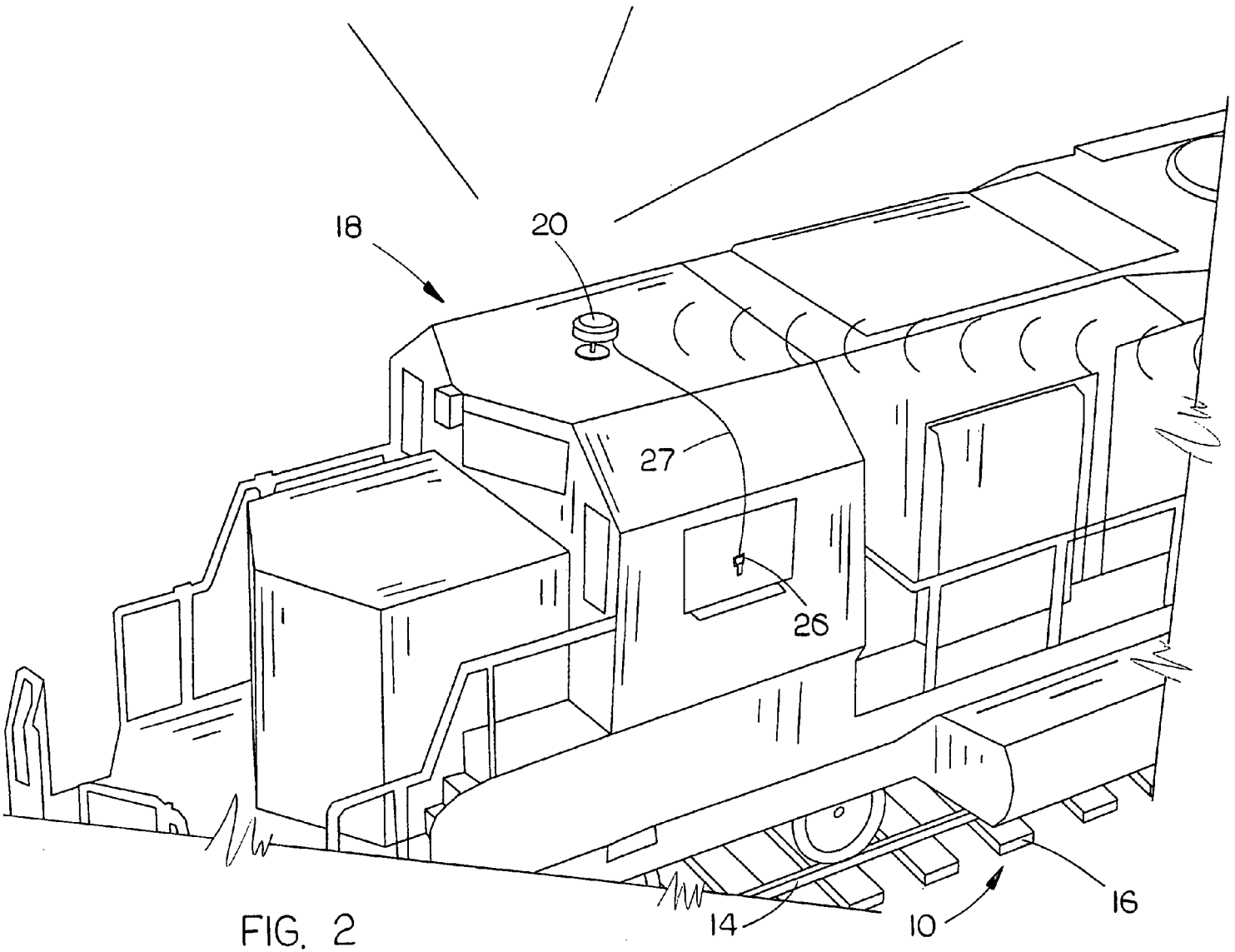
FIG. 2 is a partial perspective view of a locomotive having a GPS receiver mounted thereon which is in communication to a data collector positioned within the locomotive.

Embodiments are described more fully below with reference to the accompanying figures, which form a part hereof and show, by way of illustration, specific exemplary embodiments. These embodiments are disclosed in sufficient detail to enable those skilled in the art to practice the invention. However, embodiments may be implemented in many different forms and should not be construed as being limited to the embodiments set forth herein. The following detailed description is, therefore, not to be taken in a limiting sense in that the scope of the present invention is defined only by the appended claims.

In the drawings, the numeral 10 refers to a conventional railroad track having rails 12 and 14 supported on ties 16. The numeral 18 refers to a conventional locomotive which is adapted to move along the track 10 in conventional fashion. Although it is preferred that the track vehicle 18 is a locomotive, other track vehicles such as a high-rail vehicle or a cargo car could be utilized. The primary reason for using a locomotive is that it will have a greater weight than high-rail vehicles or cargo cars so as to cause maximum deflection of the rails 12 and 14 when the locomotive passes thereover.

In one embodiment, a conventional GPS receiver 20 is secured to the top of the locomotive 18 so that it may receive data from a plurality of satellites 22 in an unobstructive fashion. Preferably, the GPS receiver 20 is centrally positioned with respect to the rails 12 and 14 to provide data for the center of the track 10. The height of the GPS receiver 20 above the rails 12 and 14 will be determined in conventional fashion so that the data received by the GPS receiver 20 may be adjusted to subtract the height of the receiver 20 above the rails 12 and 14 from the data received from the GPS satellites 22. In other words, the data received from the satellite 22 may indicate that the GPS receiver 20 has an elevation of 1,500 feet. The distance between the upper end of the rails 12 and 14 and the GPS receiver may be 15 feet so the data will be adjusted to indicate that the rails 12 and 14 are at an elevation of 1,485 feet.

The numeral 24 refers to a stationary GPS receiver which is positioned remotely of the GPS receiver 20 and which is in communication with the satellites 22 and which is in radio communication with the GPS receiver 20 with both of the receivers observing the same satellite signals thereby increasing the accuracy of the data. If a Virtual Reference Station (VRS) network system is available in the area of the track being surveyed, it will not be necessary to utilize the stationary GPS receiver 24. The receiver 20 in communication with a hand-held data collector 26 within the locomotive 18 which is being held by a survey technician. The fact that the survey technician may ride inside the locomotive 18 increases the safety factor since the technician does not have to be physically present on the track 10 to locate features. The technician will be able to monitor the GPS satellite quality from the data collector 26. The data collector 26 is preferably a hand-held device that logs the GPS survey data from the GPS receiver 20. The data collector 26 communicates with the GPS receiver 20 by connecting a cable 27 between the receiver 20 and the data collector 26 or by using a radio connection. The technician can place descriptions on the GPS observations being logged into the data collector 26. The technician can also set the parameters of the GPS system to log data at certain intervals. The track vehicle may be moving and the survey observations can be logged and recorded. The vehicle does not have to be stopped in order to log an observation. Logging the data while the locomotive or track vehicle 18 is moving gives the ability to collect a dense amount of data in a small amount of time. The technician may set the parameters to log observations in five foot intervals, which is ten times more dense than the traditional survey requirements. If the track vehicle is traveling at five miles per hour, 1,056 observations can be made at five foot intervals in a one mile stretch, in a 12 minute time frame.

Figure 3:
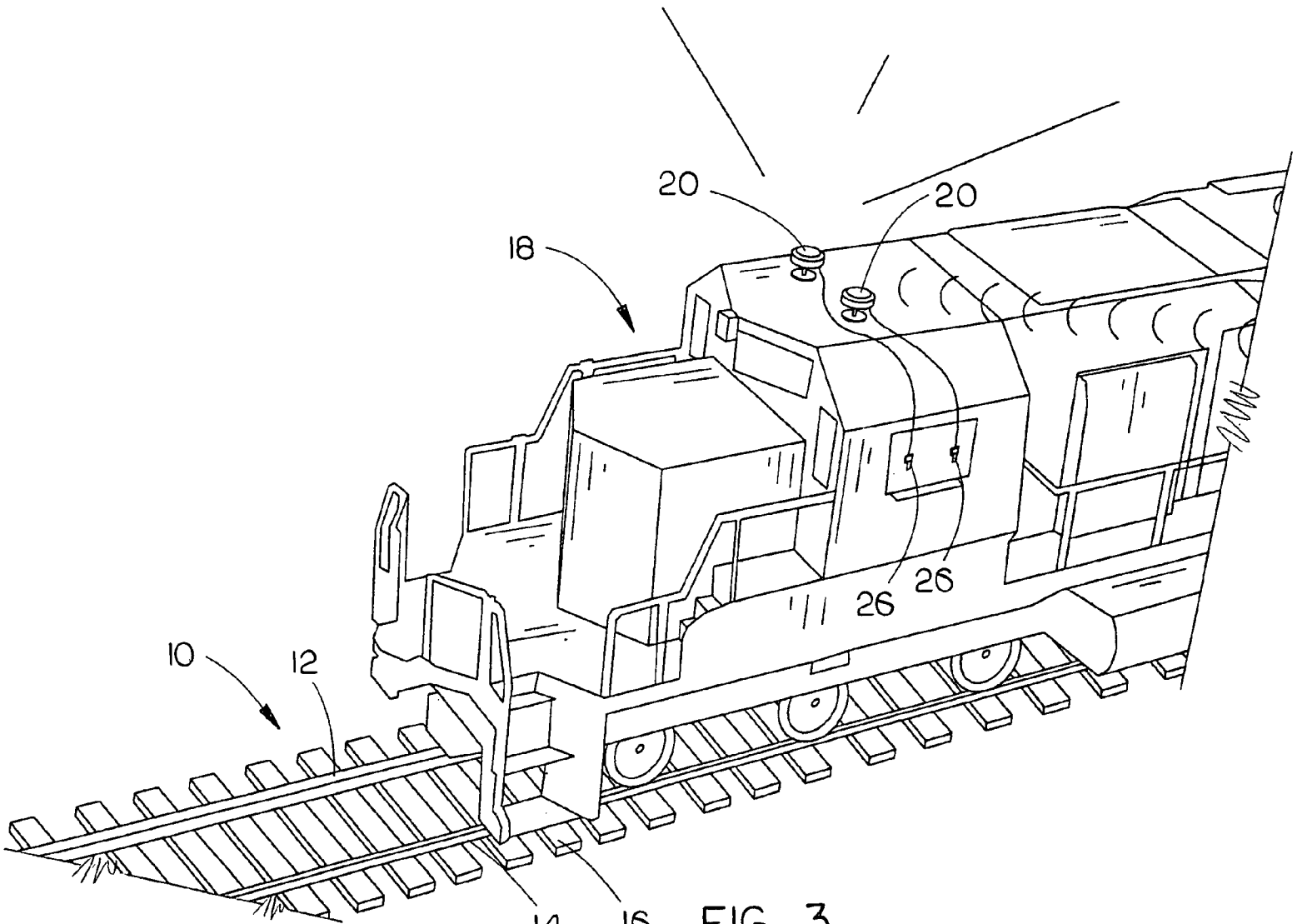
FIG. 3 is a partial perspective view of a locomotive having a pair of GPS receivers mounted thereon which are in communication with a pair of data collectors.

If it is desired to determine the position of each of the rails 12 and 14, a pair of GPS receivers 20 are placed on the track vehicle 18 with each of the receivers 20 being positioned directly above one of the rails 12 and 14 (FIG. 3). This situation will normally be used where one rail is higher than the other such as in super elevations through curves for example. In this case, an individual data collector 26 will be used for each receiver as seen in FIG. 3. Both receivers 26 will log data at the same time to compare the difference in elevation on each rail.

Thus it can be seen that a novel method has been provided for surveying a railroad track 10 which provides maximum safety to the survey technician since the survey technician may be positioned within the locomotive or other track vehicle. Further, the survey data is gathered as the locomotive 18 is moved along the track 10 which greatly decreases the time required to complete the survey. The fact that the receiver 20 is located on the top of the track vehicle ensures that the GPS signals will not be blocked by passing traffic, obstacles, etc. Receiver 20 may be secured to the top of the track vehicle 18 in any means as long as it is mounted in a manner that eliminates any movement of the GPS receiver once in place. For example, magnetic mounts may be used, suction cups may be used or the mount for the GPS could be welded to the vehicle 18.

An extremely important feature of this system is that the elevation of the track may be measured when the track is under load of the weight of the track vehicle which will indicate unstable conditions beneath the track. It can therefore be seen that the invention accomplishes all of its stated objectives.

Although the invention has been described in language that is specific to certain structures and methodological steps, it is to be understood that the invention defined in the appended claims is not necessarily limited to the specific structures and/or steps described. Rather, the specific aspects and steps are described as forms of implementing the claimed invention. Since many embodiments of the invention can be practiced without departing from the spirit and scope of the invention, the invention resides in the claims hereinafter appended.

The invention claimed is:

1. A method of surveying a railroad track with a pair of spaced-apart rails under load, comprising the steps of:

positioning a GPS receiver on a track vehicle so that the GPS receiver is in communication with a plurality of GPS satellites;

positioning a data collector on the track vehicle which is in communication with the GPS receiver so as to receive data from the GPS receiver regarding the horizontal and vertical position of the GPS receiver;

moving the track vehicle along the track whereby the track vehicle will subject the track to the load of the track vehicle; and supplying the data from the GPS receiver to the data collector at predetermined intervals as the track vehicle moves along the track.

2. The method of claim 1 wherein the track vehicle is a locomotive.

3. The method of claim 1 wherein the GPS receiver is positioned on the track vehicle midway between the rails of the track.

4. The method of claim wherein the GPS receiver is mounted on the top of the track vehicle.

5. The method of claim wherein a stationary GPS receiver is positioned remotely of the GPS receiver on the track vehicle which receives signals from a plurality of GPS satellites and which is in communication with the GPS receiver on the track vehicle.

6. A method of surveying a railroad track with a pair of spaced-apart rails under load, comprising the steps of:

positioning a first GPS receiver on a track vehicle so as to be positioned above one of the rails of the track and so as to be in communication with a plurality of GPS satellites;

positioning a second GPS receiver on a track vehicle so as to be positioned above the other rail of the track and so as to be in communication with the plurality of GPS satellites;

positioning first and second data collectors on the track vehicle which are in communication with the first and second GPS receivers respectively so as to receive data from the associated GPS receiver regarding the horizontal and vertical position of the associated GPS receiver;

moving the track vehicle along the track whereby the track vehicle will subject the track to the load of the track vehicle; and supplying the data from the first and second GPS receivers to the first and second data collectors respectively as the track vehicle moves along the track.

7. The method of claim 6 wherein the track vehicle is a locomotive.

8. The method of claim 6 wherein the first and second GPS receivers are mounted on the top of the track vehicle.

9. The method of claim 6 wherein stationary GPS receivers are positioned remotely of the GPS receivers on the track vehicle which receive signals from a plurality of GPS satellites and which are in communication with the GPS receivers on the track vehicle.

* * * * *